US005692891A

United States Patent [19]

Chow et al.

[11] Patent Number: 5,692,891

[45] Date of Patent: Dec. 2, 1997

[54] SHORT FLAME BURNER AND METHOD OF MAKING THE SAME

[75] Inventors: Andreas Chow; Herbert Maab-Emden; Uwe Neumann, all of Hamburg, Germany

[73] Assignee: U.S. Philips Corporation, New York, N.Y.

[21] Appl. No.: 540,808

[22] Filed: Oct. 11, 1995

[30] Foreign Application Priority Data

Oct. 15, 1994 [DE] Germany ..... 44 36 908.5

[51] Int. Cl.[6] ..... F23D 14/62

[52] U.S. Cl. ..... 431/354; 431/170; 431/187

[58] Field of Search ..... 431/10, 8, 7, 328, 431/329, 350, 351, 353, 354, 355, 170, 326, 181, 187

[56] References Cited

U.S. PATENT DOCUMENTS

| | | | |
|---|---|---|---|
| 3,291,189 | 12/1966 | Schade, Jr. | 431/328 |
| 4,202,660 | 5/1980 | Pei | 431/328 |
| 4,680,008 | 7/1987 | Rioux | 432/72 |
| 5,447,427 | 9/1995 | Suzuki | 431/328 |

FOREIGN PATENT DOCUMENTS

| | | |
|---|---|---|
| 283452A5 | 10/1983 | Germany . |
| 4231866A1 | 4/1993 | Germany . |

*Primary Examiner*—James C. Yeung
*Attorney, Agent, or Firm*—Steven R. Biren

[57] ABSTRACT

The invention relates to a nozzle for a combustion device in which an improved flame shape is achieved in that a bundle comprising a plurality of small tubes is arranged in an outer tube.

10 Claims, 1 Drawing Sheet

SHORT FLAME BURNER AND METHOD OF MAKING THE SAME

The invention relates to a nozzle for a combustion device, for example an injector nozzle for a quartz burner of a diffusion furnace.

BACKGROUND OF THE INVENTION

Such a nozzle is known from U.S. Pat. No. 4,680,008. An injector nozzle comprising a quartz tube with a widening end piece is present in a combustion chamber. Hydrogen ($H_2$) is introduced into the combustion chamber through this injector nozzle. Simultaneously, oxygen ($O_2$) is introduced into the combustion chamber through a further quartz tube which partially surrounds the injector nozzle. Water vapour ($H_2O$) is formed in the combustion chamber in a combustion process. Such a device is used in semiconductor manufacture for forming oxide layers in various semiconductor processes.

SUMMARY OF THE INVENTION

The present invention has for its object to provide a nozzle with an improved flame shape.

According to the invention, this object is achieved in that a bundle comprising a plurality of small tubes is arranged in a tube.

Whereas the flame in the known device has a very great length in comparison with its diameter and has a very great heat close to the exit opening of the nozzle, the flame of the device according to the invention is substantially shorter and has a greater diameter. In the known device, a small maladjustment of the injector nozzle, for example, has the result that the exit region of the nozzle is burned off progressively in time, so that the flame hits the inside wall of the combustion chamber and leads to recrystallization there. Both the recrystallization at the nozzle opening and that at the inner wall of the combustion chamber considerably increase the number of particles in the combustion chamber, which is the very thing which should be avoided in semiconductor manufacture. In the device according to the invention, the highly critical adjustment of the injector nozzle becomes redundant, while in addition the formation of particles owing to recrystallization is substantially reduced. The flame has a high heat only at some distance from the nozzle outlet opening compared with a prior art nozzle, given an equal gas flow rate, because of the higher exit velocity of the hydrogen from the nozzle, so that the nozzle is burnt off to a considerably lesser degree and accordingly can be used considerably longer.

In an embodiment of the invention, the small tubes and the tube are made of quartz. This guarantees that a minimum number of foreign particles from the nozzle itself reach the combustion chamber at the temperatures prevalent during combustion and that product quality is as high as possible, especially in semiconductor manufacture.

To achieve a secure connection between the small tubes and the tube in a further embodiment of the invention, the small tubes are fused together and are fused into the tube.

In a further embodiment of the invention, the longitudinal axes of the small tubes are mutually parallel and parallel to the longitudinal axis of the tube. This arrangement has the advantage that the difficult manufacture of the tube bundle is simplified. In addition, the direction in which the hydrogen leaves the nozzle is advantageously defined thereby, as is the shape of the flame.

A further simplification of the manufacture is achieved in a further embodiment wherein the small tubes and the tube have the shape of straight circular cylinders.

BRIEF DESCRIPTION OF THE DRAWING FIGURES

The invention will be explained in more detail below with reference to the drawing, in which:

FIG. 1 diagrammatically shows a burner for a diffusion furnace,

DESCRIPTION OF THE INVENTION

Figure 1:
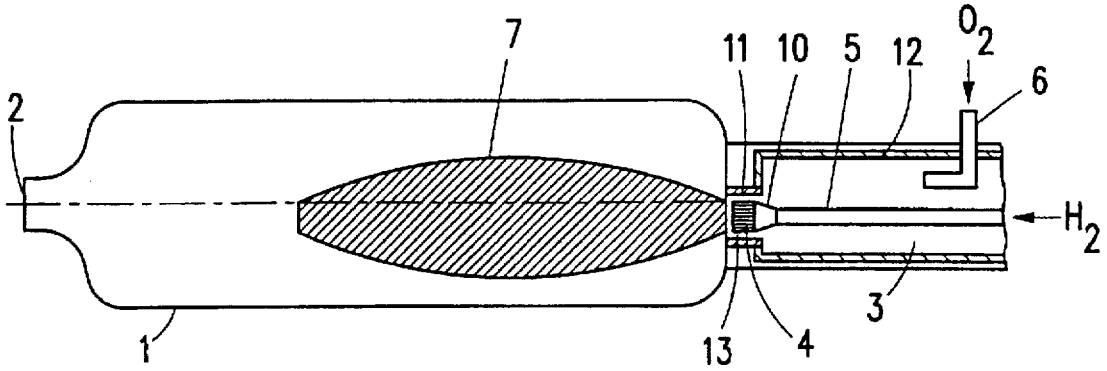

FIG. 1 shows a quartz combustion chamber 1 which narrows at one end into an outlet 2 for the water vapour generated in the combustion chamber 1. The injector 3 with the injector nozzle 4 is arranged at the other end of the combustion chamber 1. Hydrogen is passed through feed line 5 and injector nozzle 4 into the combustion chamber 1, where it mixes itself with the oxygen which is fed in through a further feed line 6 and the injector 3 and flows through the annular opening 13 around the nozzle into the combustion chamber 1. A heater element (not shown) outside the combustion chamber 1 heats the combustion chamber 1, as a result of which the hydrogen-oxygen mixture burns in the combustion chamber 1 and forms water vapour. The flame 7 has approximately the shape shown in this figure.

Figure 2:
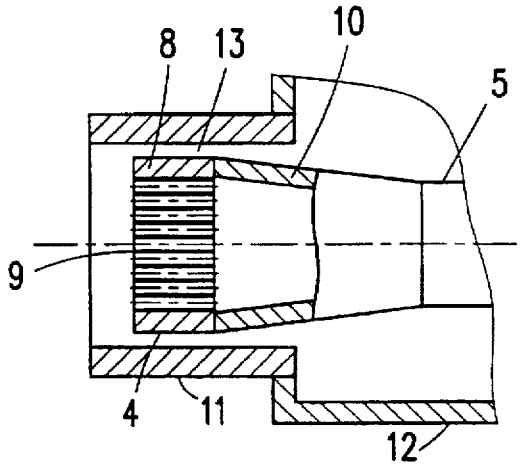
FIG. 2 shows an injector nozzle in cross-section.

FIG. 2 is a cross-section of part of the injector 3 with the nozzle 4. The nozzle comprises a tube 8 in which a bundle 9 of a number of small tubes of substantially smaller diameter than the outer tube 8 is fixedly arranged—for example, fused. The small tubes are arranged mutually parallel, are fused to one another so as to form the bundle 9, and each have the shape of a straight circular cylinder, as has the tube 8. A conical section 10 is joined to the tube 8—for example, welded thereto—to connect the nozzle 4 to the hydrogen feed line 5. The injector 3 comprises two tubes 11 and 12 joined together, a narrow, annular opening 13 remaining between the tube 11 and the tube 8 of the nozzle 4, through which opening the oxygen flows into the combustion chamber 1.

Figure 3:
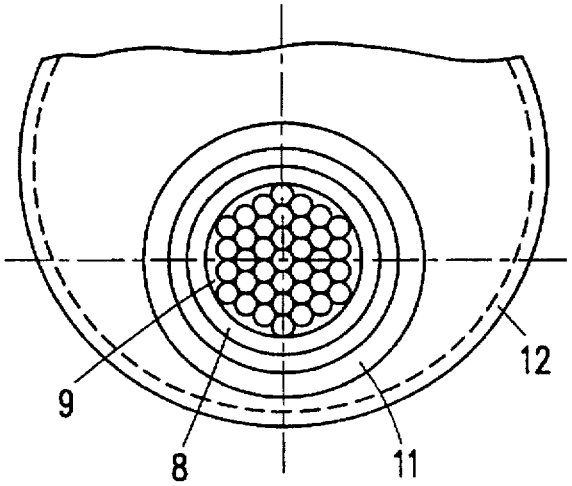
FIG. 3 shows the injector nozzle in front elevation.

The bundle 9 comprising a plurality of small tubes is clearly visible in the front elevation of the injector nozzle 4 of FIG. 3. The advantages mentioned are achieved to a particularly high degree when the bundle 9 comprises at least 25 small tubes.

In the embodiment of the invention shown, the flame 7 has a length/diameter ratio at the thickest spot of approximately 4:1, whereas a ratio of approximately 60:1 is found for the flame in the known device. Since the flame 7 does not bum directly against the outlet of the nozzle 4 in the device according to the invention, moreover, the number of particles detaching themselves from the nozzle 4 owing to recrystallization and entering the combustion chamber 1 is smaller. It is furthermore prevented thereby that the nozzle 4 becomes maladjusted after a short period of operation already, whereby the flame 7 could hit the inner wall of the combustion chamber 1 and could generate particles there through recrystallization, as in the known device. The nozzle 4 can be used approximately three times longer because burning-off of the nozzle 4 progresses substantially more slowly. Finally, product quality is improved as a result of the smaller number of particles.

The injector nozzle 4 is manufactured in that the small tubes are inserted longitudinally into the tube 8 such that the tube 8 is optimally filled. The small tubes are then fused into the tube 8 in a heating process, fused together, while at the same time the bundle 9 and the tube 8 are drawn until the desired outer diameter of the tube 8 has been achieved. In the example shown, approximately 50 small tubes of 1.5 mm diameter were inserted into a tube 8 of 20 mm diameter, upon which the tube 8 was drawn down to an outer diameter of 16.5 mm. Finally, a section of approximately 8 mm long was separated from the nozzle 4 and welded to the conical tube section 10.

Such a nozzle is used in diffusion furnaces in semiconductor manufacture, but alternative applications, such as a combustion device for hazardous gases, are also conceivable because of the very high combustion temperatures achievable with this nozzle.

We claim:

1. A short flame, high temperature burner, comprising:

an injector nozzle having an outlet opening and a source of oxidizable gas arranged to provide a flow of combustible gas through said nozzle, means for increasing the exit velocity of the combustible gas from the nozzle, said means including a bundle comprising a plurality of small tubes arranged within a nozzle tube, an outer tube, arranged generally coaxially with and surrounding said nozzle so as to form a space therebetween, and a source of oxidizer gas arranged to flow through said space to burn said oxidizable gas, said bundle being arranged such that the combustible gas flows through said bundle thereby producing a flame which is shorter, has a greater diameter, and has a high temperature at a greater distance from the nozzle outlet opening than a same nozzle lacking said bundle.

2. A burner as claimed in claim 1, characterized in that said bundle and said nozzle tube are made of quartz.

3. A burner as claimed in claim 1, characterized in that said bundle comprises at least 25 small tubes having mutually parallel longitudinal axes parallel to the longitudinal axis of the nozzle tube, fused together and fused into the nozzle tube.

4. A burner as claimed in claim 3, characterized in that said bundle and said nozzle tube are made of quartz, and said small tubes, nozzle tube and outer tube are circular cylinders.

5. A burner as claimed in claim 4, characterized in that said bundle consists of approximately 50 small tubes.

6. A hydrogen/oxygen burner, comprising:

an injector nozzle having an outlet opening and a source of hydrogen arranged to provide a flow of hydrogen through said nozzle, means for increasing the exit velocity of the hydrogen from the nozzle, said means including a bundle comprising a plurality of small quartz tubes arranged within a quartz nozzle tube, an outer tube, arranged generally coaxially with and surrounding said nozzle so as to form a space therebetween, and a source of oxygen arranged to flow through said space to burn said hydrogen, said bundle being arranged such that the hydrogen flows through said bundle thereby producing a flame which is shorter, has a greater diameter, and has a high temperature at a greater distance from the nozzle outlet opening than a same nozzle lacking said bundle.

7. A burner as claimed in claim 6, characterized in that said bundle comprises at least 25 small tubes, and said small tubes have mutually parallel longitudinal axes parallel to the longitudinal axis of the nozzle tube, and are fused together and fused into the nozzle tube.

8. A burner as claimed in claim 7, characterized in that said small tubes, nozzle tube and outer tube are circular cylinders.

9. A burner as claimed in claim 8, characterized in that said nozzle and outer tube are arranged to produce a flame having a length/diameter ratio at the thickest spot of approximately 4:1.

10. A burner as claimed in claim 8, characterized in that said bundle consists of approximately 50 small tubes.

* * * * *